United States Patent [19]

Akkerman et al.

[11] 4,345,651

[45] Aug. 24, 1982

[54] APPARATUS AND METHOD FOR THE MECHANICAL SEQUENTIAL RELEASE OF CEMENTING PLUGS

[75] Inventors: Neil H. Akkerman, Kingwood; Gonzalo Vazquez, Houston, both of Tex.

[73] Assignee: Baker International Corporation, Orange, Calif.

[21] Appl. No.: 133,363

[22] Filed: Mar. 21, 1980

[51] Int. Cl.[3] ..... E21B 33/16

[52] U.S. Cl. ..... 166/291; 166/155

[58] Field of Search ..... 166/70, 291, 155

[56] References Cited

U.S. PATENT DOCUMENTS

| | | | |
|---|---|---|---|
| 2,737,244 | 3/1956 | Backer et al. | 166/330 |
| 2,810,441 | 10/1957 | Baker | 166/330 |
| 3,010,514 | 11/1961 | Fox | 166/284 |
| 3,130,783 | 4/1964 | Orr | 166/284 |
| 3,151,839 | 10/1964 | Mott | 166/334 |
| 3,386,701 | 6/1968 | Potts | 166/330 |
| 3,507,325 | 4/1970 | Scott | 166/70 |
| 3,616,850 | 11/1971 | Scott | 166/70 |

*Primary Examiner*—James A. Leppink

*Attorney, Agent, or Firm*—William C. Norvell, Jr.

[57] ABSTRACT

An apparatus and method are provided for holding and selectively mechanically releasing at least one plug device utilized in cementing a subterranean well, preferably a subsea well. The apparatus is securable and carryable on a manipulatable conduit, such as a drill string, communicating with the well. The apparatus comprises a cylindrical housing control head means positioned within the housing, shiftable in response to manipulation of the conduit from closed position, whereby the plug device is prevented from passing through the control head means, to open position, whereby the plug device is permitted to pass through the control head means. Means are provided for transferring at least one of longitudinal and rotational manipulation of the conduit to the control head means to selectively shift the control head means between closed and open positions. Subsequent to shifting of the control head means to open position, the plug device may be pumped through the control head means. When plural plugs are desired, companion plural control head means are selectively and sequentially manipulatable to open position.

8 Claims, 13 Drawing Figures

APPARATUS AND METHOD FOR THE MECHANICAL SEQUENTIAL RELEASE OF CEMENTING PLUGS

BACKGROUND OF THE INVENTION

1. Field of the Invention

The invention relates to an apparatus and method that provide positive mechanical control from the surface of a well, or from a drill ship or platform, of the release of plugs used during a cementing operation of a subterranean well.

2. Description of the Prior Art

As a step in the completion operation of a subterranean well, casing is run into the well and the annular area exterior of the casing and within the open bore thereafter is cemented to secure the casing within the well. Cementing plugs are utilized in the cementing operation and are run ahead of the cement slurry in order to wipe mud off the walls of the casing and to prevent cement from being contaminated with the drilling fluid previously circulated within the casing and the well. Such plugs are oftentimes run into the well within the casing and behind a cement slurry in order to close off check valves, open stage collars, and reclose stage collars during multi-stage cementing operations.

When subsea wells are completed utilizing drill ships or floating platforms, it is difficult to tie back the casing string to the surface of the platform or drill ship because of the motion between the platform or drill ship and the subsea well head. Typically, cementing operations under such conditions have incorporated cementing plugs which have been affixed to the bottom of the drill string by shear pins, collet releasing mechanisms, or the like. After the drill string is landed in the well head, the cement plugs are released from engaged position on the drill string by dropping or pumping balls, darts, and the like, to hydraulically activate the release of the plugs. The drill pipe containing the secured cementing plugs is run on a drill pipe having a conventional expansion joint to longitudinally compensate for the movement of the drill ship on the ocean, and the drill pipe is tied back to the well head. Now, because the drill pipe is tied back, a full size cementing plug cannot be pumped or inserted through the drill pipe.

Regardless of whether the cementing operation is performed on an off-shore or inland well, most prior art plug dropping mechanisms are not completely reliable for efficient sequential release of the plugs, because of the use of hydraulic activation means to disengage the plug from its secured position, prior to pumping the plug downhole.

The present invention provides an apparatus and method for release of plugs without the use of auxiliary pumpable means, such as balls, darts, shear pins and the like. The present invention incorporates an apparatus which sequentially releases the plugs from their respective heads in a sequential, highly reliable, operation which is dependent only upon rotational manipulation of the drill pipe or other conduit to release the plugs from the engaged position relative to the pipe or conduit. When utilized above an off-shore well, the apparatus provides means for release of the plugs above the ocean floor and above the well head, and thus further provides a more reliable means of releasing plugs.

SUMMARY OF THE INVENTION

The present invention provides a method and apparatus for holding and selectively mechanically releasing one or more plug devices which are used in cementing a subterranean well, preferably an off-shore well which is completed from a floating platform or drill ship. The apparatus is securable on a rotationally manipulatable conduit communicating with the well. The apparatus comprises an elongated cylindrical housing and control head means which are positioned within the housing and preferably having a flow passageway therethrough. The control head means is rotatably shiftable in response to manipulation of the conduit from closed position, whereby the plug device is prevented from passing through the control head means, to open position, whereby the plug device is permitted to pass through the control head means. Means are provided on the apparatus for transferring manipulation of the conduit to the control head means to selectively shift the control head means between open and closed positions. When plural plug devices are desired for use in the cementing operation, companion plural control head means are provided which are sequentially shifted from closed to open positions. Subsequent to opening of a given control head means, fluid is transmitted in auxiliary fluid passage means to pump the released plug downwardly through the apparatus and into the casing.

BRIEF DESCRIPTION OF THE DRAWINGS

FIG. 6A showing the lowermost plug dropping head in open position; FIG. 6B showing the two lowermost plug dropping heads in open position; FIG. 6C illustrating the first, second and third plug dropping heads being in open position; and FIG. 6D illustrating the positioning of the camway sleeve when all of the plug dropping heads are manipulated to open position.

DESCRIPTION OF THE PREFERRED EMBODIMENTS

Figure 1:
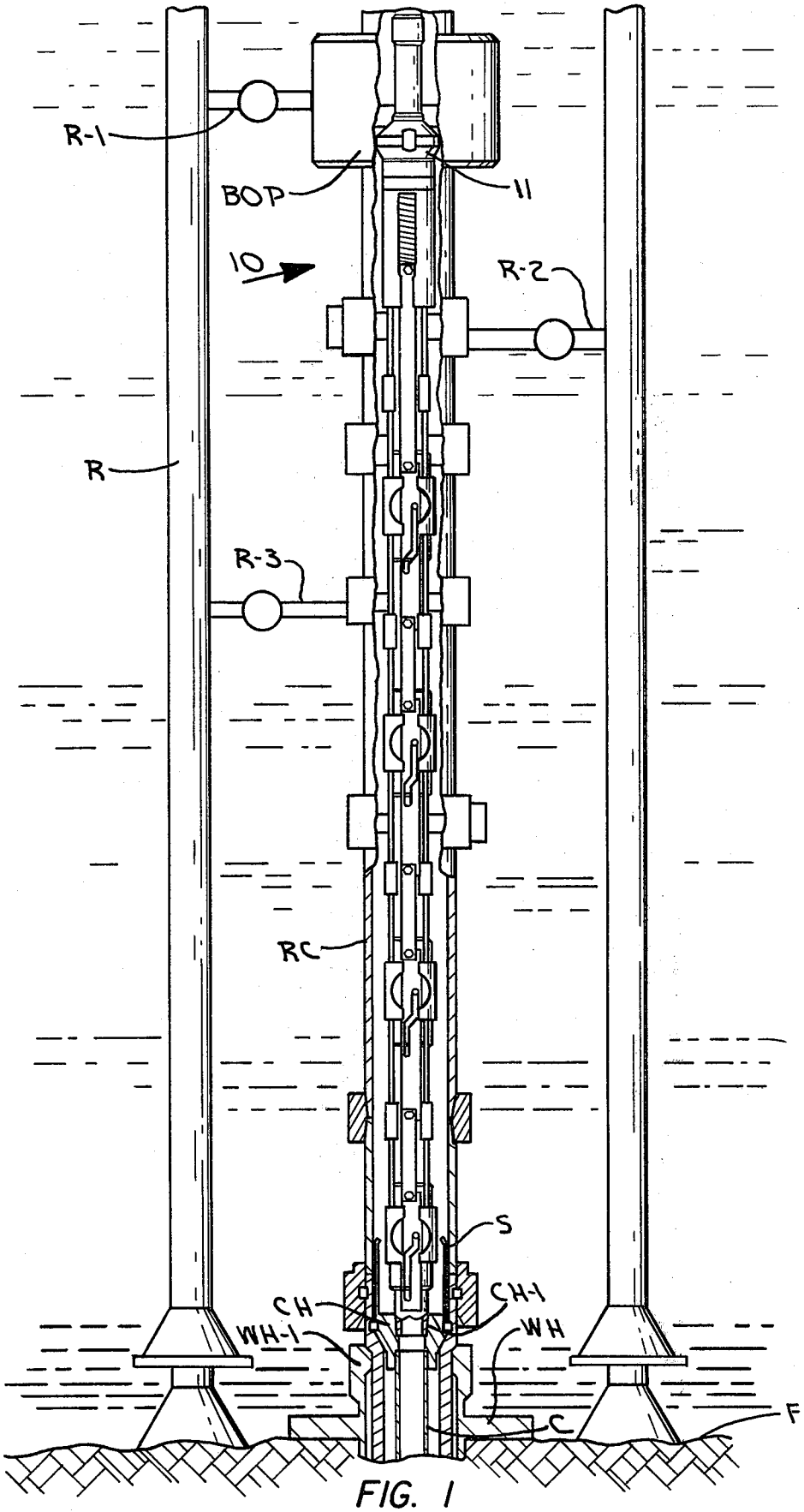
FIG. 1 is schematic illustration of a typical subsea well head installation, and illustrating the plug dropping or releasing apparatus of the present invention positioned within a blow out preventer stack above the well head, the lower end of the apparatus being disposed within the interior of the uppermost end of a casing hanger.

As shown in FIG. 1, the apparatus 10 is positioned within a blow out preventer stack R having its lowermost end resting upon the ocean floor F, arms R1, R2 and R3 extending interiorly within the stack R and being sequentially and longitudinally separated from one another to centrally secure the apparatus 10 within the stack R.

The apparatus 10 is run on the lower end of a drill string DS (FIG. 2) and is set within a conduit RC, the uppermost end of the apparatus 10 being located within the lowermost portion of a blow out preventer BOP, the lowermost end of the apparatus 10 extending to the uppermost end of a casing hanger CH having a shoulder CH1 for receipt of the apparatus 10. A string of casing C extends within the well through the well head WH below the ocean floor F. An anchoring shoulder WH1 on the well head WH positions the conduit RC in the well head WH. An elastomer seal S is provided to seal within the interior of the conduit RC.

Figure 2:
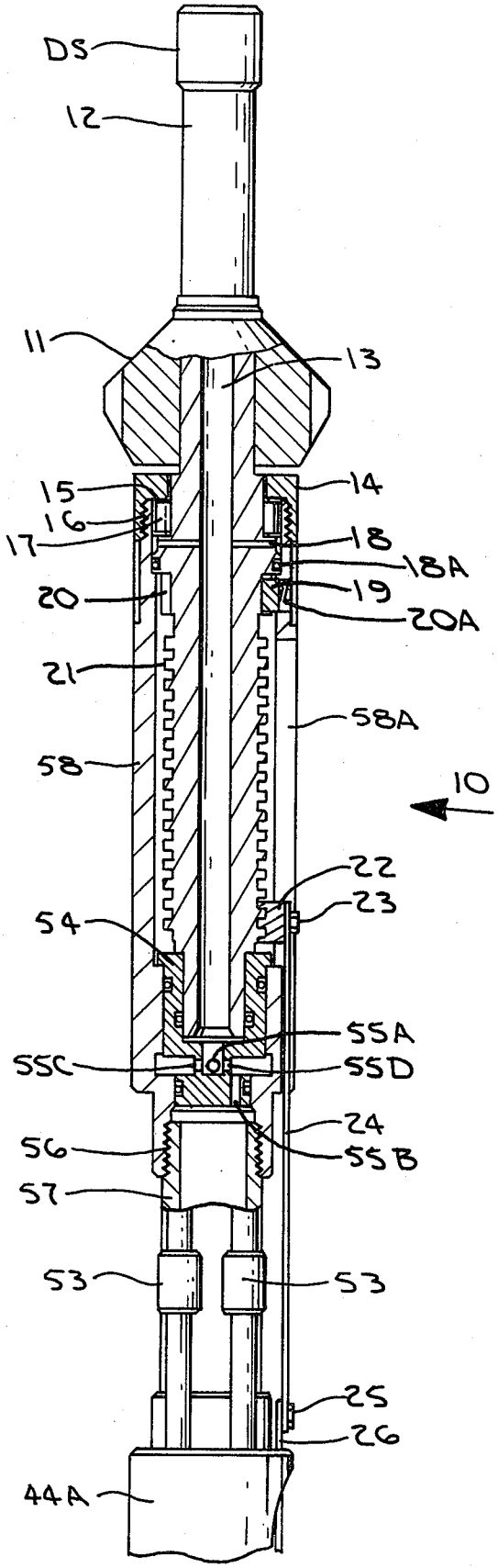
FIG. 2 is an enlarged longitudinal partially sectioned view of the actuator mechanism, off-set 90° from the view of FIG. 1.

Now referring to FIG. 2, the apparatus 10 has a longitudinally extending drive mandrel 12 which is affixed by conventional means, such as threads, to the lowermost end of drill or work string DS extending from the drill ship or floating platform. A radially and circumferentially extending guide element 11 is defined on the drive mandrel 12 which prevents the apparatus 10 from binding within the conduit RC as the apparatus 10 is rotatably manipulated to sequentially release the cementing plugs. A drive nut housing 14 is secured at threads 16 to a longitudinally extending actuator housing 58. An upper bearing assembly 17, in conjunction with a lower bearing assembly 54, permits rotation of the drive mandrel 12 in one direction relative to the actuator housing 58 during rotation of the drill string DS to manipulate the plug dropping heads from closed to open position. A bearing retainer member 15 extends circumferentially around the exterior of the drive nut housing 14 to secure it between the drive mandrel 12 and the actuator housing 58.

A transverse passageway 18 is defined through the drive mandrel 12 below the upper bearing assembly 17 and communicates with an interior passageway 13 longitudinally extending through the apparatus 10 and communicating to the drill string DS, the interior passageway 13 transmitting fluid mud and cement from the drill string DS to the well. The transverse passageway 18 is provided to permit pressure within the drill string DS to hydrostatically balance the component parts within the actuator housing 58 above a circumferentially extending elastomeric O-ring seal element **18*a*** to assure that there are no axial forces transmitted to the drill string DS.

A profiled ratchet drive extension 20 circumferentially extends around a portion of the actuator housing 58 to receive a ratchet 19 urged interiorly by means of a compressed biasing spring element **20*a* to transmit rotation of the drill string DS in one direction, such as right-hand rotation, through the drive mandrel 12 and into the actuator housing 58 such that the apparatus 10** will rotate as a unit when the drill string DS is rotated in one direction for remedial actions involving securing the seal S between the riser conduit RC and the casing C, or the like.

A series of longitudinally extending circularly slanting drive thread elements 21 are provided circumferentially around the exterior of the drive mandrel 12 for receipt of companion threads on a drive nut element 22 which, in turn, carries, by means of a bolt or other securing means 23 a drive arm assembly having an uppermost drive arm member 24 for manipulating control pins within camway slots provided on the drive arm assembly to sequentially manipulate each of the plug dropping heads from closed to open position for dropping of the plugs during the cementing operation. As the drill string DS and the drive mandrel 12 affixed thereto are rotated in one direction, the drive nut 22 will move longitudinally upwardly within a drive slot **58*a* profiled within the actuator housing 58 and the drive nut 22 will travel along the threads 21** carrying the drive arm assembly for manipulation of the plug dropping heads.

Figure 3:
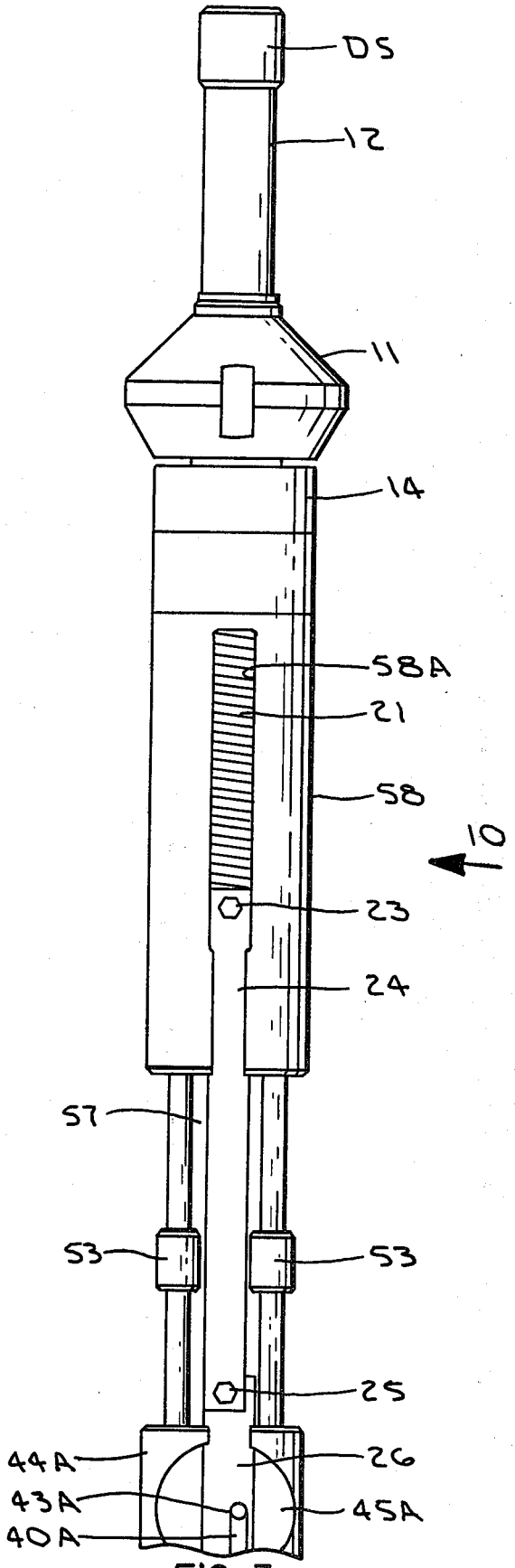
FIG. 3 is a schematic view, off-set 90° from the view of FIG. 2, illustrating the exterior of the actuator component and upper plug dropping head of the apparatus.
Figure 4:
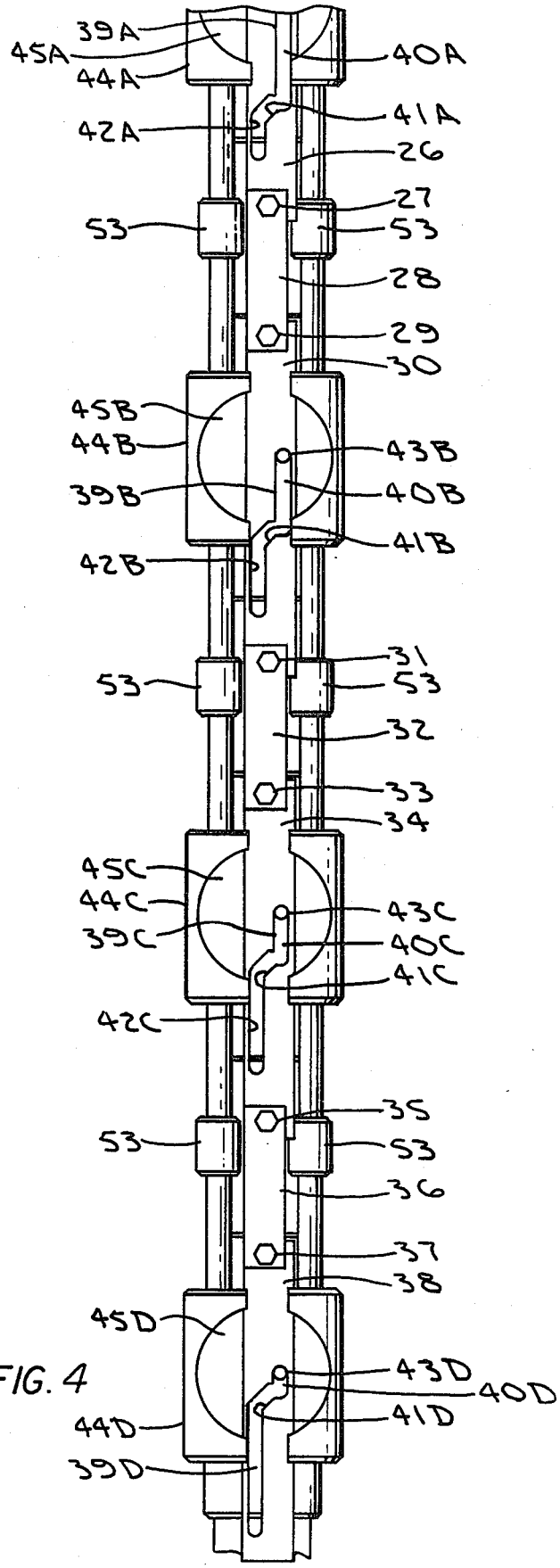
FIG. 4 is a longitudinally extending exterior illustration of the plug dropping heads of the apparatus and the actuator sleeves, each of the heads being in closed position.
Figure 5:
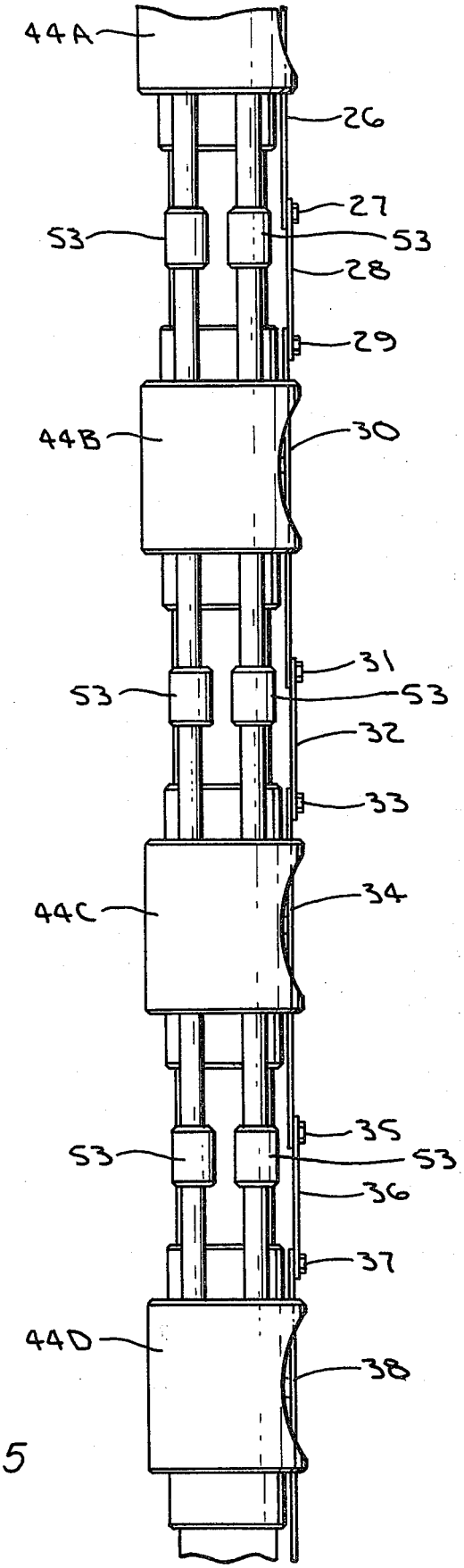
FIG. 5 is a view similar to that of FIG. 4, and off-set 90° from the view shown in FIG. 4.

As best shown in FIGS. 3 and 4, the drive arm assembly is, as stated above, secured at its uppermost end to the drive nut 22 by a bolt 23 received through the uppermost end of a first or upper drive arm member 24 which, in turn, is connected to a downwardly extending drive arm member 26 by means of a bolt 25. Similar bolts 27, 29, 31, 33, 35 and 37 secure companion downwardly extending arm members 28, 30, 32, 34, 36 and 38, one to another, respectively. The drive arm assembly provides a series of four camways **39*a*, 39*b*, 39*c* and 39*d* adjacent one side of the plug dropping head assemblies 44*a*, 44*b*, 44*c* and 44*d*, respectively. The camways define a running slot 40*a*, 40*b*, 40*c* and 40*d* for respective receipt of control pins 43*a*, 43*b*, 43*c* and 43*d* mounted on one side of the control heads 45*a*, 45*b*, 45*c* and 45*d***.

It will be noted that the running slot **40*a* on the uppermost, or fourth, control head 45*a* is longer than the running slot 40*b* on the control head 45*b* of the next, or third, plug dropping head 44*b*, the running slot 40*b* being somewhat longer than the running slot 40*c* of the second plug dropping head 44*c*, the running slot 40*d* of the lowermost, or first, plug dropping head 44*d* having the shortest length. Such a configuration is provided to enable shifting of the first control pin 43*d* on to an angularly off-set rotation slot 41*d* to rotate the first or lower control head 45*d* from closed to open position prior to any of the fourth, third and second control pins 43*a*, 43*b* and 43*c*, from being shifted into their respective rotation slots 41*a*, 41*b* and 41*c*. Likewise, the running slot 40*c* is somewhat shorter than the running slot 40*b*, to permit the second control pin 43*c* to enter into its rotation slot 41*c* to manipulate the control head 45*c* to open position, before movement occurs between the control pin 43*b* and the control head 45*b*, as well as between the uppermost control pin 43*a* and the control head 45*a*. Finally, the running slot 40*b* in the third plug dropping head assembly 44*b* is somewhat longer than the running slot 40*a* of the uppermost or fourth plug dropping head 44*a* to permit shifting of the third control pin 43*b* into its rotation slot 41*b* prior to manipulation of the uppermost plug dropping head 44*a*** from closed to open position.

After each of the control pins 43*a* 43*b*, 43*c* and 43*d* travel along their respective rotation slot and the particular control head is manipulated from closed to open position, the pin will be shifted into its respective longitudinally extending sequential dropping slot 42*a*, 42*b*, 42*c* and 42*d* during the next rotation of the drill string DS to drop the next plug. Thus, the fourth or uppermost plug dropping head 44*a* is functional with the shortest sequential dropping slot 42*a* on its camway 39*a*. The sequential dropping slot 42*b* immediate the third or next plug dropping head 44*b* is somewhat longer to permit travel of the third control pin 43*b* as the fourth or upper control pin 43*a* is manipulated within the running slot 40*a* and the rotation slot 41*a*. Continuing, the second plug dropping head 44*c* has the sequential dropping slot 42*c* on its camway 39*c* proportionately elongated relative to the third head 44*b* to permit travel of the second control pin 43*c* as the third control pin 43*b* travels within the running slot 40*b* and into the rotation slot 41*b*. Finally, the sequential dropping slot 42*d* of the lowermost, or first, plug dropping head 44*d*, and on the camway 39*d*, is the longest of all of the sequential dropping slots to permit the first control pin 43*d* to travel therein, as the second, third and fourth control pins, 43*d* 43*b* and 43*a* are manipulated from their respective running slot to the particular rotation slot.

Figure 8A:
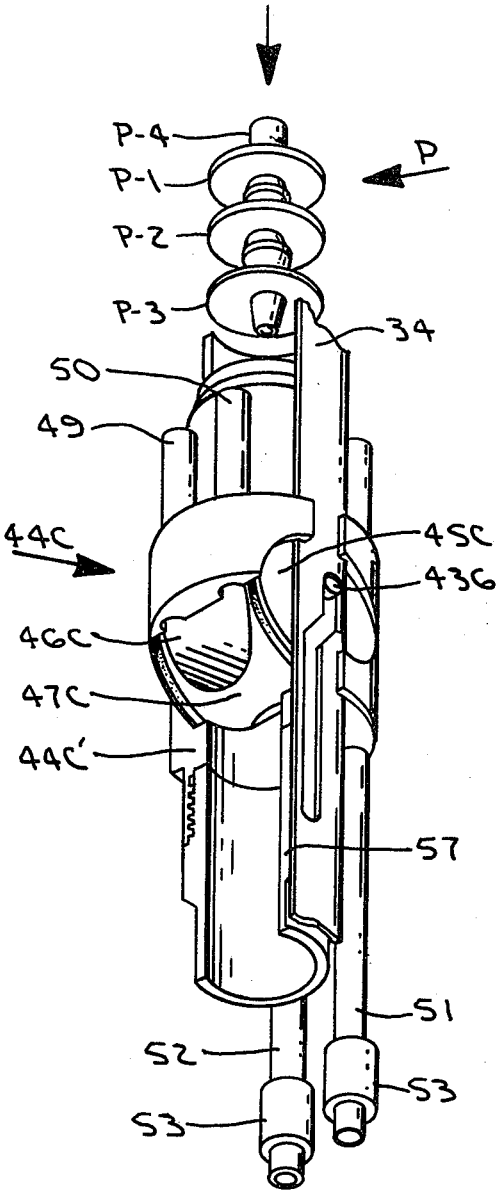
FIG. 8A is a perspective, dimensionalized illustration of a plug dropping head assembly when manipulated to closed position, a typical cementing plug being shown thereabove, and parallel cement flow tubes being circumferentially extended around the exterior of the plug dropping head.
Figure 8B:
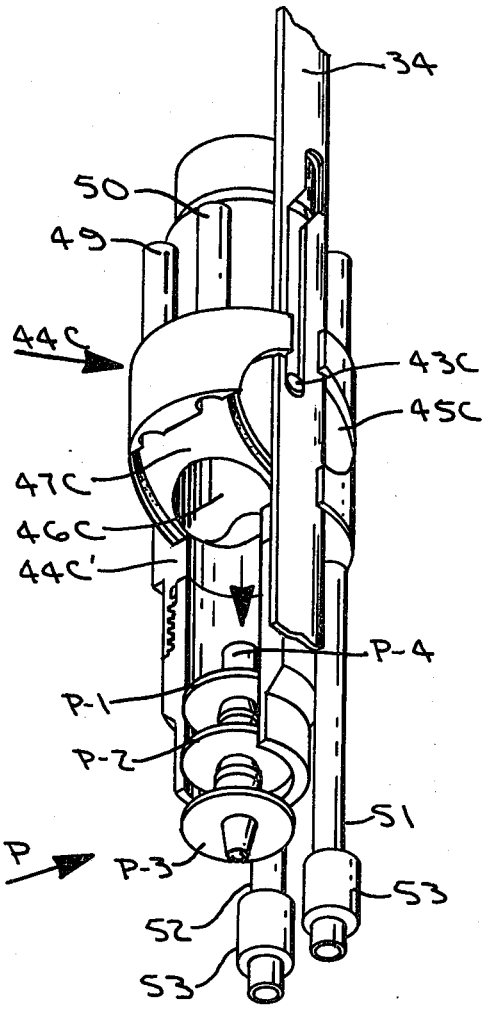
FIG. 8B is a view similar to that of FIG. 8A, showing the plug dropping head manipulated to open position and a plug being pumped therethrough and positioned within the interior of the apparatus below the plug dropping head.

Now referring to FIGS. 8A and 8B, the second plug dropping head assembly 44*c* is shown in dimensionalized views. It will be understood that each of the plug dropping heads 44*a*, 44*b*, 44*c* and 44*d* are of substantially identical design. The plug dropping head assembly 44*c* is mounted by means of its housing 44*c*′ to the control housing 57. A rotatable control head member 45*c* is carried within the housing 44*c*′ with a control pin 43*c* mounted on one side thereof and received within the running slot 40*c* of the camway 39*c* on the drive arm member 34. A flow passageway 46*c* having substantially the same internal diameter as the internal diameter of the casing C is provided through the control head 45*c*. A solid bridge 47*c* is provided on the control head 45*c* on each side which, when the control head 45*c* is in the position as illustrated in FIG. 8A, has one end across the interior passageway 13 of the apparatus 10 to provide a barrier against downward movement of a plug P, located immediately above the control head 45*c*.

Now referring to FIG. 8B, when the control head 45*c* is manipulated to the open position, the bridge 47*c* moves to each side of the plug dropping head assembly 44*c* and the passageway 46*c* is completely in alignment with the interior of the housing 44*c*′, and is in full communication with the interior passage 13 of the apparatus 10 to permit the plug P to pass through the plug dropping head assembly 44*c*.

A series of four cementing plugs P, of conventional and known design, are positioned just above the control heads 45*a*, 45*b*, 45*c* and 45*d*. Each plug P has a longitudinal body P-4 carrying longitudinally spaced, circumferentially extending wiper flaps P1, P2 and P3 which will wipe against the interior of the control housing 57 of the apparatus 10 and the interior of the casing C as the plug P is moved therethrough.

Now referring to FIGS. 1, 2 and 8A, a series of four parallel flow conduits 49, 50, 51 and 52 are carried by the apparatus 10 and are sequentially spaced around the circumferential exterior of the plug dropping head housing 57, each of the plugs communicating within the actuator housing 58 with the interior passageway 13 and the interior of the drill string DS for transmission of mud and cement from the drill ship or floating platform through the well during the cementing operation. Although it is not necessary to provide four parallel flow conduits, it is desirable to provide multiple conduits whose total areas will substantially equal the areas of the interior passageway 13 and that of the drill string DS to afford maximum flow capacity through the flow conduits and into the interior of the casing C. The flow conduits 49, 50, 51 and 52 permit fluid to be transmitted downwardly of each of the plug dropping heads 44*a*, 44*b* and 44*c* so that fluid can be transmitted into the well as each of these plug dropping heads are bypassed when the control heads 45*a*–*d* are manipulated to closed position.

The parallel flow conduits 49–51 respectively begin through flow passageway ports 55*a*, 55*b*, 55*c* and 55*d* defined within the actuator housing 58 for communication with the interior passageway 13. As shown in FIG. 4, the conduits 49–51 pass through the uppermost end of each of the plug dropping heads 44*a*–*d* and pass out of the lowermost end thereof. Each flow conduit 49–51 has an adjustable pup connection 53 for securing lengths of each flow conduit between each of the plug dropping heads 44*a*–44*d*.

The parallel flow conduits 49–51 terminate exterior of the control housing 57 within the lowermost control head 45*d* in the lower plug dropping head 44*d* and communicates therebelow with the interior passageway 13 in the apparatus 10, and into the interior of the casing C just above the ocean floor F within the casing hanger CH.

Now referring to FIGS. 7A, 7B, 8A and 8B, the parallel flow conduits 49–51 are secured to the uppermost end of each of the housings, such as 44*c*′, each housing having bored parallel flow passageway extensions 48*c*′, 48*c*″ 48*c*‴ and 48*c*⁗ therethrough for continuing the parallel flow conduits through each of the plug dropping heads, such as 44*c*. As particularly shown in FIG. 7A, each flow passageway 48*c*′–48*c*⁗ is bored 160° through the housing 44*c*′. Therefore, when the control head, such as 45*c* shown in FIG. 8A, is manipulated to the closed position, such that the bridge 47*c* prevents the plug P from passing therethrough, fluid transmission through the parallel flow conduits 49–51 will pass through the flow passageways, such as 48*c*′–48*c*⁗, and lowerly thereof into the parallel flow conduit members therebelow. Also, because the passageway, such as 46*c*, is within the radial area of 180° opposite the 180° bored portion of the flow passageways through the housing 44*c*′, fluid also will be transmitted through the passageway, such as 46*c*, and downwardly of the plug dropping head, such as 44*c*, thence through the interior passageway 13, and pressure will be exerted upon the uppermost flap P1 of the next and lower plug P.

Figure 7A:
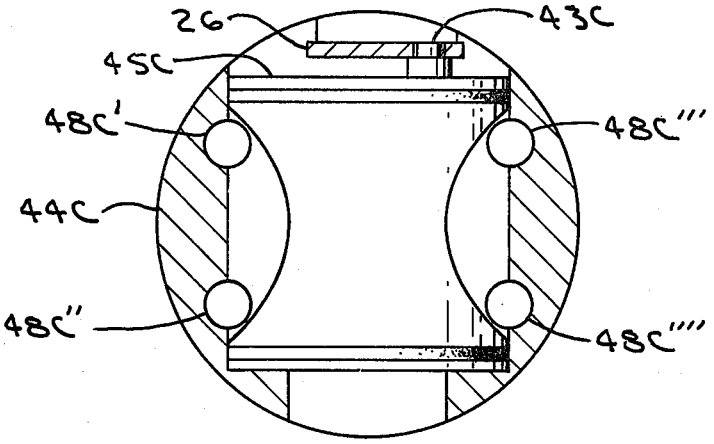
FIG. 7A is a cross-sectional view taken along line 7A—7A of FIG. 6A, illustrating a typical plug dropping head of the present invention in closed position.
Figure 7B:
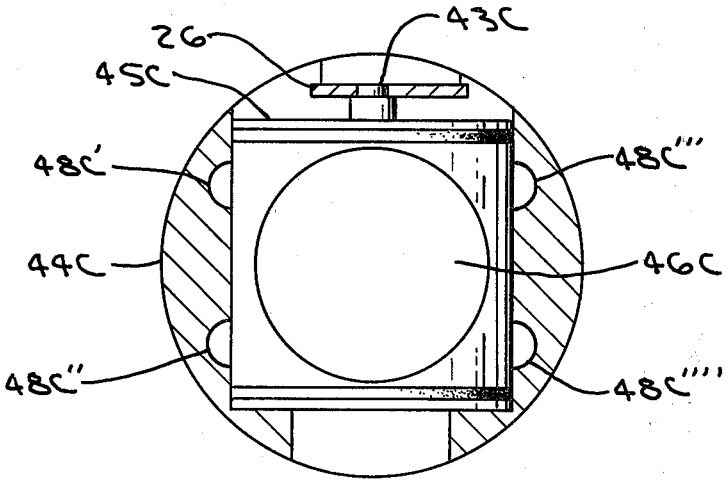
FIG. 7B is a view similar to that of FIG. 7A and taken along line 7B—7B of FIG. 6B and showing a typical plug dropping head of the present invention in open position.

When a control head of a plug dropping head assembly, such as control head 45*c* of the assembly 44*c* shown in FIG. 8B, is manipulated to the open position for dropping of the plug P therethrough, the passageway 46*c* will become completely aligned with the interior of the housing 44*c* and the interior passageway 13, as shown in FIG. 7B. Now, the complete radius of the flow passageways 48*c*′–48*c*⁗ is traversed 180°, and fluid cannot enter into the interior passageway 13 within each plug dropping head, such as 44*c*. Fluid now will bypass the interior portion of the plug assembly, but may be communicated downwardly within each of the respective parallel flow conduits.

OPERATION

Prior to running of the apparatus 10 on the drill string DS, it is necessary to properly locate each of the plugs P within their respective plug dropping heads 44*a–d*, just slightly above the respective control heads 45*a–d*. Accordingly, the drive arm assembly is disengaged from the drive mandrel 12 by disengaging the drive arm member 24 from the drive nut 22 by removing the bolt 23. Thereafter, the drive arm assembly is manually manipulated so that all of the control pins 43*a–d* are shifted to their lowermost position within their respective sequential dropping slots 42*a–d*, and the control heads 45*a–d* are manipulated to the fully open position such that each passageway 46*a–d* is in conformity with its housing 44*a'–c'*. In order to insert the plugs P through the plug dropping head housing 57 for respective location within the plug dropping heads, the drive nut housing 14, bearing retainer 15, drive mandrel 12 and lower bearing assembly 54 are removed from the actuator housing 58. Now, each of the four plugs P are manually inserted at the uppermost end of the drive mandrel 12 and through the interior passageway 13 for location within each of the respective plug dropping heads 44*a–d* and just above the uppermost end of the respective control head assembly 45*a–d*. The drive arm assembly thereafter is manually manipulated longitudinally downwardly, moving each control pin 43*a–d* from the lowermost end of the sequential dropping slot 42*a–d* into the rotation slot 41*a–d* and thence to the uppermost end of the running slot 40*a–d*. As the pin 43*a* moves relatively from the sequential dropping slot 42*a–d* into the rotation slot 41*a–d*, each control head assembly 45*a–d* is manipulated from the open position shown in FIG. 8B to the closed position shown in FIG. 8A.

The lower bearing assembly 54 is reinstalled in place within the actuator housing 58. Thereafter the upper bearing assembly 17, bearing retainer 15 and drive nut housing 14 are secured in place and the drive mandrel 12 run within the actuator housing and secured to the drive nut 22. The upper drive arm member 24 is secured again to the drive nut 22 by means of insertion of the bolt 23.

Subsequent to running the casing C within the well below the ocean floor F, the casing hanger CH is secured thereto and landed within the well head WH. The casing C is sealed with respect to the well head WH by means of a pack-off assembly for driving into place the seal S. The apparatus 10 is lowered on the end of the drill string DS and landed within the blow out preventer stack BOP and on to the shoulder CH-1 of the casing hanger CH. The rams (not shown) of the stack BOP may be closed around the upper portion of the drive mandrel 12 above the guide 11, if desired.

Mud now may be circulated down the drill string DS through the interior passageway 13 of the apparatus 10 and through the parallel flow conduits 49, 50, 51 and 52, thence within the interior passageway 13 below the lowermost plug dropping head 44*d* and into the interior of the casing C. The mud will pass from within the interior passageway 13 through each of the parallel flow conduits 49–51 at the passageways 55*a*, 55*b*, 55*c* and 55*d* within the actuator housing 58. The mud is circulated within the well to condition the hole.

It should be noted that when fluid is so transmitted, any pressure differential is equalized across each of the plug dropping head assemblies 44*a–d* because fluid pressure is passed above and below each such head, and each such head is filled with mud to keep cement from entering the interior in order to prevent clogging of component parts. The mud is permitted to pass interiorly within each of the plug dropping head assemblies 44*a–d* through the passageway 46*a–d* traversing the bored flow passageways, such as 48*c'–*48*c''''*, within the control heads 45*a–d*.

After the well has been conditioned with mud, the surface flow lines (not shown) are moved from the mud pit to the cement pumping assembly. The drill string DS is rotated a predetermined number of turns to the left at the drill ship, or floating platform, by application of a pipe wrench or power tongs to the string DS. The drill string DS should be permitted to move freely, even though the apparatus 10 is secured within the blow out preventer BOP and the conduit RC, because of the guide 11 preventing binding between the apparatus 10 and the interior of the conduit RC.

Figure 6A:
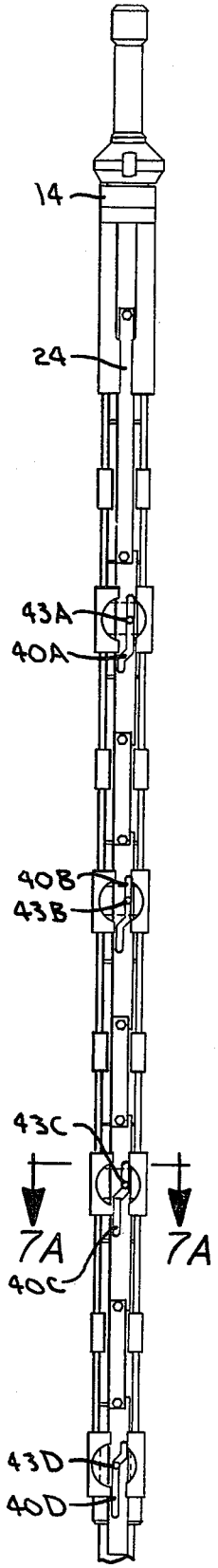
FIGS. 6A, 6B, 6C and 6D are sequential exterior side schematic views of the apparatus, illustrating the position of the actuator sleeve and the respective plug dropping heads as each plug dropping head is manipulated from closed to open position.

As shown in FIG. 6A, as the drill string is rotated, the drive nut 22 progresses up the helical spiral relative to the drive mandrel 12, carrying the drive arm assembly upwardly with it. The drive arm member 38 will move upwardly, such that the first or lowermost control pin 43*d* on the lowermost plug dropping head assembly 44*d* will move relatively downwardly within the running slot 40*d* and angularly shift into the rotation slot 41*d* to rotationally manipulate the control head 45*d* from the closed position to the open position. Now, flow of fluid is blocked below the lowermost control head 45*d* and within the interior of the control housing 57. However, flow of fluid will pass within the second plug dropping head assembly 44*c* through the passageway 46*c* and within the interior of the control housing 57 to act upon the uppermost flap P1 of the plug P initially secured just slightly above the lowermost control head 45*d* within the lowermost or first plug dropping head assembly 44*d*. As fluid pressure is exerted upon the uppermost flap P1 of the plug P, located within the lowermost plug dropping head 44*d*, it is pumped through the open passageway 46*d* and through the control housing 57 therebelow and within the casing C. The plug, being above the last of the mud and below the cementing column, will wipe and clean the interior of the casing C ahead of the cementing column.

Figure 6B:
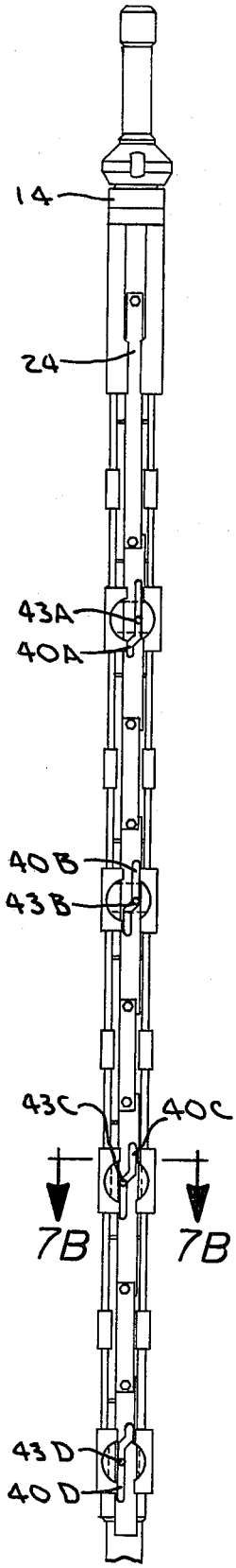

After displacement of cement and prior to recirculation of mud, the drill string DS again is rotated a predetermined number of turns in the same direction, i.e., the left, at the drill ship or floating platform. As shown in FIG. 6B, the rotation moves the drive nut 22 upwardly along the threads 21 of the drive mandrel 12 to shift the drive arm assembly further upwardly. Now, the second control pin 43*c* has been shifted from its initial position within the running slot 40*c* and into the rotation slot 41*c* to shift the control head 45*c* from the closed position to the open position, as shown in FIG. 8B. Now, fluid flow through the central housing 57 below the second plug dropping head assembly 44*c* is prevented, but fluid may pass within the control housing 57 through the passage 46*b* in the third plug dropping head assembly 44*b*, just upwardly of the second plug dropping head assembly 44*c*. As mud is pumped through the drill string DS and within the parallel flow conduits 49–51, it will enter within the interior of the control housing 57 within the plug dropping head assembly 44*b* to act upon the uppermost flap P1 of the plug P positioned within the second plug dropping head assembly 44*c* to pump it through the open control head 45*c*. Now, cement is pumped through the drill string DS and the parallel flow conduits 49–51 and the two cement plugs released from the first and second plug dropping head assemblies **44*d* and 44*c*** are transmitted within the casing C to the bottom of the well.

The lowermost plug will be located within the well and a pressure indicated reflected at the surface of the well will signal that cement is starting to be transmitted exterior of the casing within the annular area between the well bore and the casing. Pressure now is increased such that the flaps P1, P2 and P3 of this plug P will fold so that cement can be circulated through the exterior of the casing. When the second plug P is landed within the bottom of the well, it will seal off the well bore.

Figure 6C:
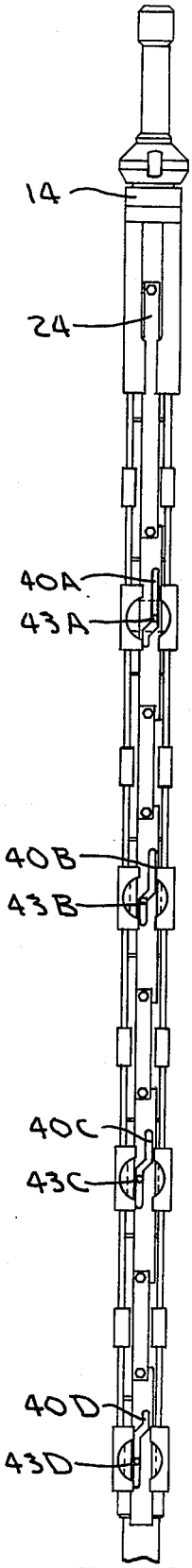

The second stage cementing operation may be effected by rotating the drill string DS a predetermined number of turns in the same direction, i.e., to the left, to cause the drive nut 22 again to move upwardly on the threads 21 of the drive mandrel 12 within the actuator housing 58 of the apparatus 10 to carry the drive arm assembly correspondingly upwardly to move the third control pin **43*b* from its uppermost position within the running slot 40*b* into the rotation slot 40*b* into the rotation slot 41*b* in the camway 39*b* of the third plug dropping head assembly 44*b*. Now, the control head 45*b* is rotatably manipulated from the closed position to the open position and the plug P housed initially thereabove is permitted to be pumped therethrough. This position is shown in FIG. 6C**.

This third plug P generally is utilized to cause a stage collar (not shown) located within the well on the casing C to be shifted openly for transmission of fluids therethrough and within the annular area between the well bore and the casing C thereabove. The well bore normally will be conditioned with mud by circulating it therethrough. Thereafter, cement will be circulated within the drill string DS, through the interior passageway 13 and through the parallel flow tubes 49–51.

Figure 6D:
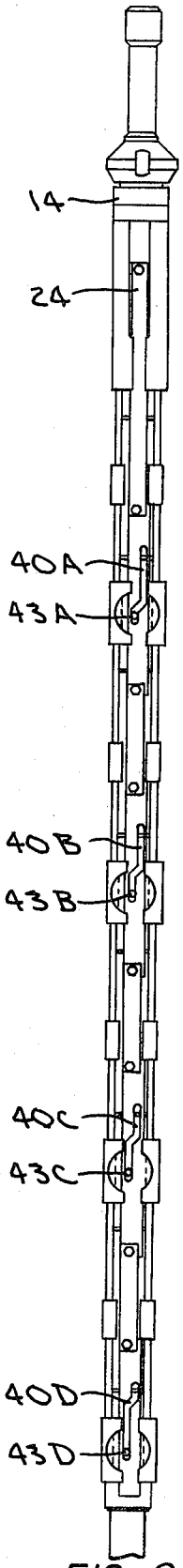

After the cementing operation has been completed, and prior to circulating additional mud within the drill string DS, the drill string DS again is rotated a predetermined number of turns, i.e., to the left, to move the drive nut 22 on the drive threads 21 of the drive mandrel 12 to the final and uppermost position to carry the drive arm assembly correspondingly upwardly, such that the fourth control pin **43*a* moves within its running slot 40*a* and into its rotation slot 41*a* to shift the uppermost control head 45*a* in the fourth and uppermost plug dropping head assembly 44*a* from the closed position to the open position to permit the uppermost plug P to be freely passed through the uppermost control head 45*a*. This position is as shown in FIG. 6D. As the plug P passes through the apparatus 10** and into the casing C it will rest upon the stage collar (not shown) to reclose it. The cementing operation now is complete.

In order to pack-off the casing, the rams in the blow out preventer BOP are opened, if they were previously closed, and the drill string DS is rotated in the opposite direction, i.e., to the right. Now, such rotation will cause the ratchet 19 to become secured on the ratchet drive 20, such that continued right-hand rotation will carry the drive mandrel 12, the actuator housing 58 and the head housing 57 together as one unit. Now, the pack-off assembly within the casing hanger containing the seal S will elastomerically pack-off the casing C within the well head WH.

The casing hanger running tool (not shown) is disconnected from the casing pack-off assembly. The drill string DS is pulled upwardly such that the apparatus 10 is retrieved from the interior of the conduit RC.

Cleaning and redressing of the apparatus 10 may be effected simply by removing the drive nut housing 14, bearing retainer 15, upper bearing assembly 17, lower bearing assembly 54 and the drive mandrel 12 from within the actuator housing 58.

Additionally, it should be noted that each of the members of the drive arm assembly may be easily disconnected one from another for convenient cleaning and dislodging of cured cement. The control heads may be easily removed from within the plug dropping head assemblies for easy cleaning.

Several variations in the assembly can be made, depending upon the particular application and individual preference. For example, the bolts 25, 27, 29, 31 33, 35 and 37 may be replaced with T-slot and T-element configurations on the drive arm assembly members to afford easier redressing of the apparatus 10 subsequent to the cementing operation. Additionally, ball valve elements may be utilized instead of plug valve elements. In a ball valve design modification, the external parallel flow conduits 49–51 may not be necessary, because circulation ports can be defined in an annular area between the body of the ball valve element and the body of the plug dropping head assembly. Instead of the use of parallel exterior flow conduits 49–51 liners are defined within outer housings, the liners having a milled slot down their length for transmission of fluid therethrough.

Utilization of a ball valve design would permit cementing of a comparatively large casing inside a comparatively smaller diameter blow out preventer stack. For example, 13 inch casing could be cemented inside of a $16\frac{3}{4}$ blow out preventer stack, because the ball valve design inherently will have a very narrow wall section.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An apparatus for holding and selectively mechanically releasing a plug device used in cementing a subterranean well, said apparatus being securable on a longitudinally and rotationally manipulatable conduit communicating with said well, said apparatus comprising: an elongated cylindrical housing; control head means positioned within said housing and having a flow passageway therethrough, said control head means being rotatably shiftable in response to manipulation of said conduit from closed position whereby said plug device is prevented from passing through said control head means to open position whereby said plug device is permitted to pass through said control head means; means for transferring at least one of longitudinal and rotational manipulation of said conduit to said control head means to selectively shift said control head means between closed and opened positions; a valve element disposed in said control head means with a central flow way therethrough and a bridge exteriorly on said valve element, said valve element, when in closed position, positioning said bridge within the interior of said cylindrical housing to prevent passage of said plug device therethrough, said valve element, when manipulated to open position, moving said flow way to substantial alignment with said flow passageway to permit fluid transmission through said cylindrical housing and to permit passage of said plug device therethrough, said control head means comprising at least one auxiliary flow passageway ported therethrough and off-set from said central flow way, whereby when said valve element is in closed position, fluid transmitted through said auxiliary flow passageway may enter into said valve element and within said elongated cylindrical housing therebelow, and, when said valve element is in open position, said bridge traverses said auxiliary flow passageway and prevents fluid transmission from said auxiliary flow passageway through said valve element and within said cylindrical housing therebelow.

2. An apparatus for holding and selectively mechanically releasing a plug device used in cementing a subterranean well, said apparatus being securable on a longitudinally and rotationally manipulatable conduit communicating with said well, said apparatus comprising: an elongated cylindrical housing; control head means positioned within said housing and shiftable in response to manipulation of said conduit from closed position whereby said plug device is prevented from passing through said control head means to open position whereby said plug device is permitted to pass through said control head means; and means for transferring at least one of longitudinal and rotational manipulation of said conduit to said control head means to selectively shift said control head means between closed and open positions, said means for transferring at least one of longitudinal and rotational manipulation of said conduit comprising a threaded drive mandrel securable to said conduit and drive arm means secured to said drive mandrel at one end thereof and extending to said control head means.

3. An apparatus for holding and selectively mechanically releasing a plug device used in cementing a subterranean well, said apparatus being securable on a longitudinally and rotationally manipulatable conduit communicating with said well, said apparatus comprising: an elongated cylindrical housing; control head means positioned within said housing and shiftable in response to manipulation of said conduit from closed position whereby said plug device is prevented from passing through said control head means to open position whereby said plug device is permitted to pass through said control head means; and means for transferring at least one of longitudinal and rotational manipulation of said conduit to said control head means to selectively shift said control head means between closed and open positions, said means for transferring at least one of longitudinal and rotational manipulation of said conduit comprising actuator means for transferring one of linear and rotary motion to the other of linear and rotary motion; drive arm means extending from said actuator to said control head means; camway drive means profiled on said drive arm; and control drive means extending from said control head means into said camway means and movable relatively therein for shifting said control head means between closed and opened positions.

4. An apparatus for holding and selectively mechanically releasing a plug device used in cementing a subterranean well, said apparatus being securable on a longitudinally and rotationally manipulatable conduit communicating with said well, said apparatus comprising: an elongated cylindrical housing; control head means positioned within said housing and shiftable in response to manipulation of said conduit from closed position whereby said plug device is prevented from passing through said control head means to open position whereby said plug device is permitted to pass through said control head means; means for transferring at least one of longitudinal and rotational manipulation of said conduit to said control head means to selectively shift said control head means between closed and open positions; and plural control head means positioned within said housing and sequentially shiftable from closed position to open position, one after another.

5. An apparatus for holding and selectively mechanically releasing a plug device used in cementing a subterranean well, said apparatus being securable on a longitudinally and rotationally manipulatable conduit communicating with said well, said apparatus comprising: an elongated cylindrical housing; control head means positioned within said housing and shiftable in response to manipulation of said conduit from closed position whereby said plug device is prevented from passing through said control head means to open position whereby said plug device is permitted to pass through said control head means; means for transferring at least one of longitudinal and rotational manipulation of said conduit to said control head means to selectively shift said control head means between closed and open positions; and auxiliary fluid transmission means for transmitting fluids downwardly of and through said cylindrical housing and for pumping said plug device through said control head means when said control head means is in open position.

6. The apparatus of claim 5 wherein said auxiliary fluid transmission means comprises plural parallel flow conduits spaced circumferentially around the exterior of said elongated cylindrical housing.

7. In a method of cementing a subterranean well wherein plug devices are dropped within a first conduit in the well, the steps of: (1) extending to said first conduit an apparatus for holding and selectively mechanically releasing a plug device used in cementing said well, said apparatus being securable on a longitudinally and rotationally manipulatable second conduit communicating with said well, said apparatus comprising: an elongated cylindrical housing; control head means positioned within said housing and shiftable in response to manipulation of said second conduit from closed position whereby said plug device is prevented from passing through said control head means to open position whereby said plug device is permitted to pass through said control head means; means for transferring at least one of longitudinal and rotational manipulation of said second conduit to said control head means to selectively shift said control head means between closed and open positions; a valve element disposed in said control head means with a central flow way therethrough and a bridge exteriorly on said valve element, said valve element, when in closed position, positioning said bridge within the interior of said cylindrical housing to prevent passage of said plug device therethrough, said valve element, when manipulated to open position, moving said flow way to substantial alignment with said flow passageway to permit fluid transmission through said cylindrical housing and to permit passage of said plug device therethrough; said control head means comprising at least one auxiliary flow passageway ported therethrough and off-set from said central flow way, whereby when said valve element is in closed position, fluid transmitted through said auxiliary flow passageway may enter into said valve element and within said elongated cylindrical housing therebelow, and, when said valve element is in open position, said bridge traverses said auxiliary flow passageway and prevents fluid transmission from said auxiliary flow passageway through said valve element and within said cylindrical housing therebelow; (2) manipulating said second conduit to activate said means for transferring at least one of longitudinal and rotational manipulation to shift said control head means from closed position to open position; and (3) pumping fluid through said second conduit and said apparatus to permit said plug device to be moved through said control head means, out of said apparatus and into said first conduit.

8. An apparatus for holding and selectively mechanically releasing a plug device used in cementing and off-shore subsea well, said apparatus being landable within a blow out preventer stack positionable on the sea bed floor, said apparatus being securable on a longitudinally and rotationally manipulatable conduit communicating with said well, said apparatus comprising: an elongated cylindrical housing; control head means positioned within said housing and shiftable in response to manipulation of said conduit from closed position whereby said plug device is prevented from passing said control head means, to open position whereby said plug device is permitted to pass through said control head means and through and below said blow out preventer stack; and means for transferring at least one of longitudinal and rotational manipulation of said conduit to said control head means to selectively shift said control head means between closed and opened positions.

* * * * *